United States Patent [19]

Anderson

[11] 4,075,788

[45] Feb. 28, 1978

[54] LINKAGE ASSEMBLY FOR A WINDOW

[75] Inventor: Howard R. Anderson, Dunlap, Ill.

[73] Assignee: Caterpillar Tractor Co., Peoria, Ill.

[21] Appl. No.: 750,095

[22] Filed: Dec. 13, 1976

[51] Int. Cl.[2] ..... E05F 11/00

[52] U.S. Cl. ..... 49/324; 49/356

[58] Field of Search ..... 49/356, 324, 252, 248, 49/249; 160/36–38

[56] References Cited

U.S. PATENT DOCUMENTS

| | | | |
|---|---|---|---|
| 1,746,556 | 2/1930 | Preston | 49/356 X |
| 1,791,808 | 2/1931 | Dreher | 49/252 X |
| 2,043,349 | 6/1936 | DeCary | 49/324 X |
| 2,188,231 | 1/1940 | Pond | 29/324 |

FOREIGN PATENT DOCUMENTS

| | | | |
|---|---|---|---|
| 690,871 | 6/1930 | France | 49/324 |

*Primary Examiner*—Philip C. Kannan

*Attorney, Agent, or Firm*—Wegner, Stellman, McCord, Wiles & Wood

[57] ABSTRACT

An improved linkage assembly is provided for opening and closing a panel, such as a window or the like, and for locking said panel in an infinite number of positions between a fully opened and a fully closed position. The linkage assembly has a plurality of symetrically arranged and pivotally interconnected links with a lock for securing two overlapping links together to set the ends of the linkage assembly in a fixed position relative to each other.

1 Claim, 5 Drawing Figures

LINKAGE ASSEMBLY FOR A WINDOW

BACKGROUND OF THE INVENTION

1. FIELD OF THE INVENTION

This invention relates to hinged panel actuators and more particularly to an improved linkage and locking assembly for opening and closing a hinged panel, such as a hinged window.

2. DESCRIPTION OF THE PRIOR ART

Hinged panels, and in particular hinged windows for use on cabs of heavy equipment have been known and in demand for some time. The current actuators for said windows or panels are of many different varieties, all of which fall somewhat short of being fully satisfactory. One such actuator is a slotted bar pivotally attached at one end to the window frame with the body of a threaded stud extending through the slot in the bar. The stud is fastened to the frame of the cab with a knob threaded into the stud to lock the bar and thus the window in a desired position. When the window is closed, the bar projects into the cab presenting a safety hazard and an inconvenience.

Another current form of actuator is a two-part pivoted link passing through a block on the frame of the cab with a brake mounted on the block for locking window in position after the window has been manually pushed open.

There are other varieties of actuators, all of which necessitate space for relatively long links to swing or lie during storage or use. The actuators have projecting parts or pieces which are dangerous, are space consuming, are not positive in their locking ability, are subject to rattling during use of the vehicle, and become loose and release the window, sometimes with a startling and resounding noise.

SUMMARY OF THE INVENTION

An improved linkage and locking assembly is provided for a panel, such as a window, which is positive in its latching ability, occupies a minimum of space both during use and during storage and reduces the transmission of vibrations thereby reducing noise and looseness. More specifically, a collapsible scissors-type crossover linkage is provided between the window and the frame of the cab with a knob threaded onto a threaded pivot passing through a crossover junction of the linkage, such that turning the knob on the pivot in one direction will lock the linkage to prevent further elongation or foreshortening of the assembly.

The parts of the linkage are pivoted together in a firm fashion so as to reduce the transmission of vibrations from the frame of the cab to the window. The scissors-type linkage is strong and positive such that turning of the knob in one direction loosens the linkage making it possible to push the knob toward the window to open up the linkage assembly and the window or to pull the knob toward the inside of the cab to collapse the linkage assembly and to close the window. When the window is in the desired position, the knob is again turned to lock the linkage assembly and the window in the desired location.

The collapsible linkage assembly takes up a minimum of space and the location of the knob and lock on the assembly is ideally located for easy actuation and locking of the linkage assembly, and thus the window, in place.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
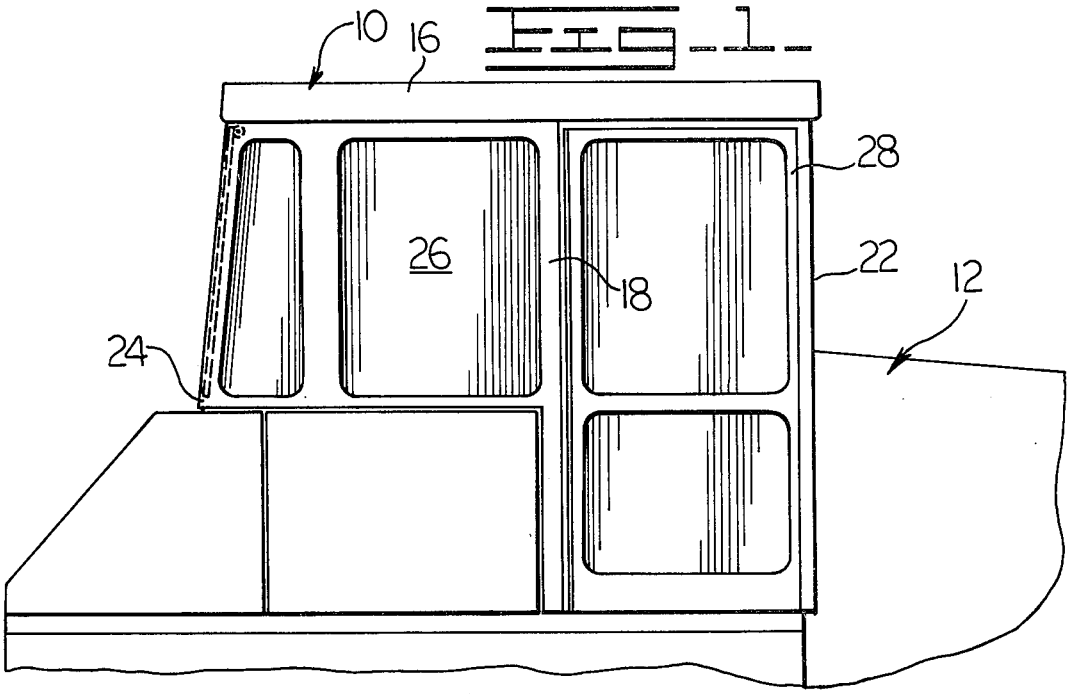
FIG. 1 is an elevational view of a cab on a piece of road equipment incorporating the improved design.
Figure 2:
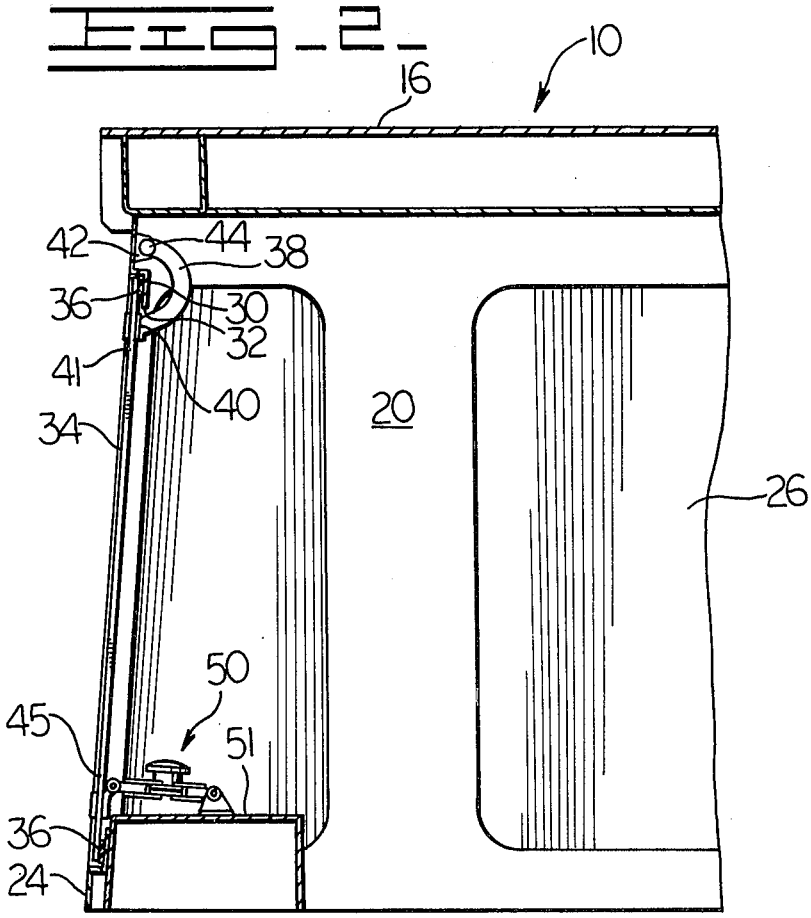
FIG. 2 is an enlarged, broken away, version of FIG. 1 shown in vertical section through the cab.
Figure 3:
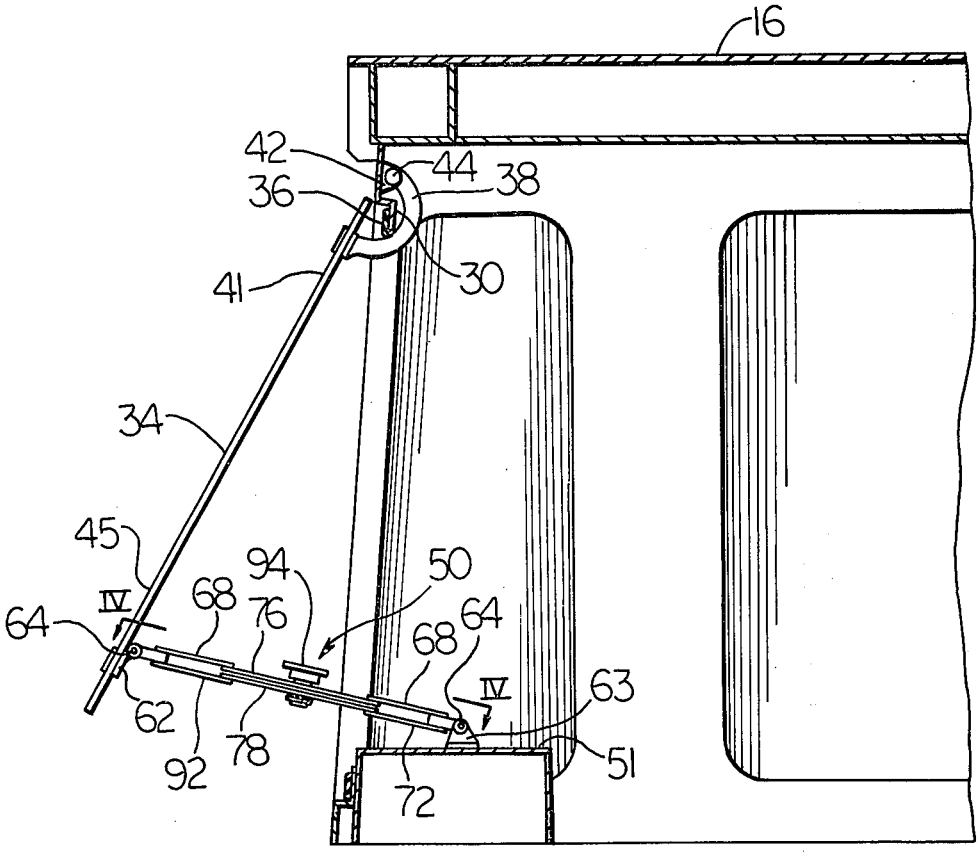
FIG. 3 is an enlarged view, similar to FIG. 2, with the window held in the open position by the improved linkage assembly.
Figure 4:
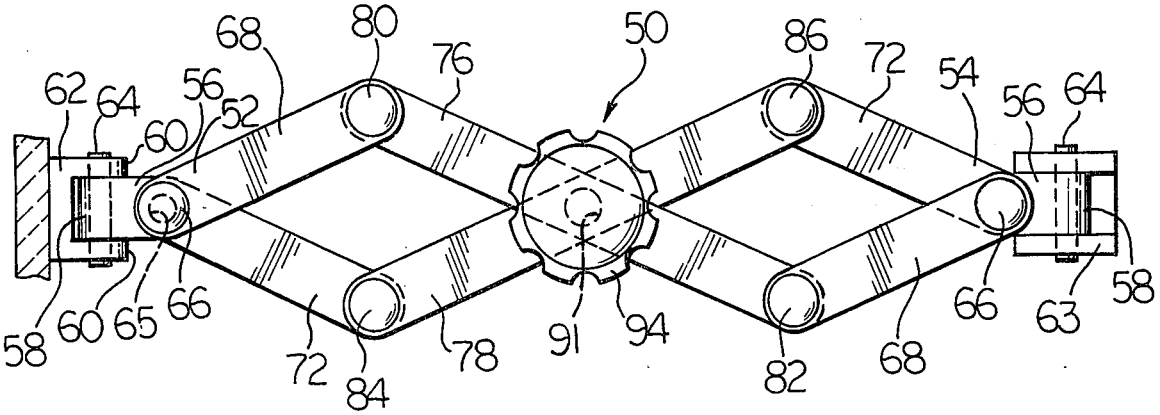
FIG. 4 is an enlarged top plan view of the linkage assembly of FIG. 3.
Figure 5:
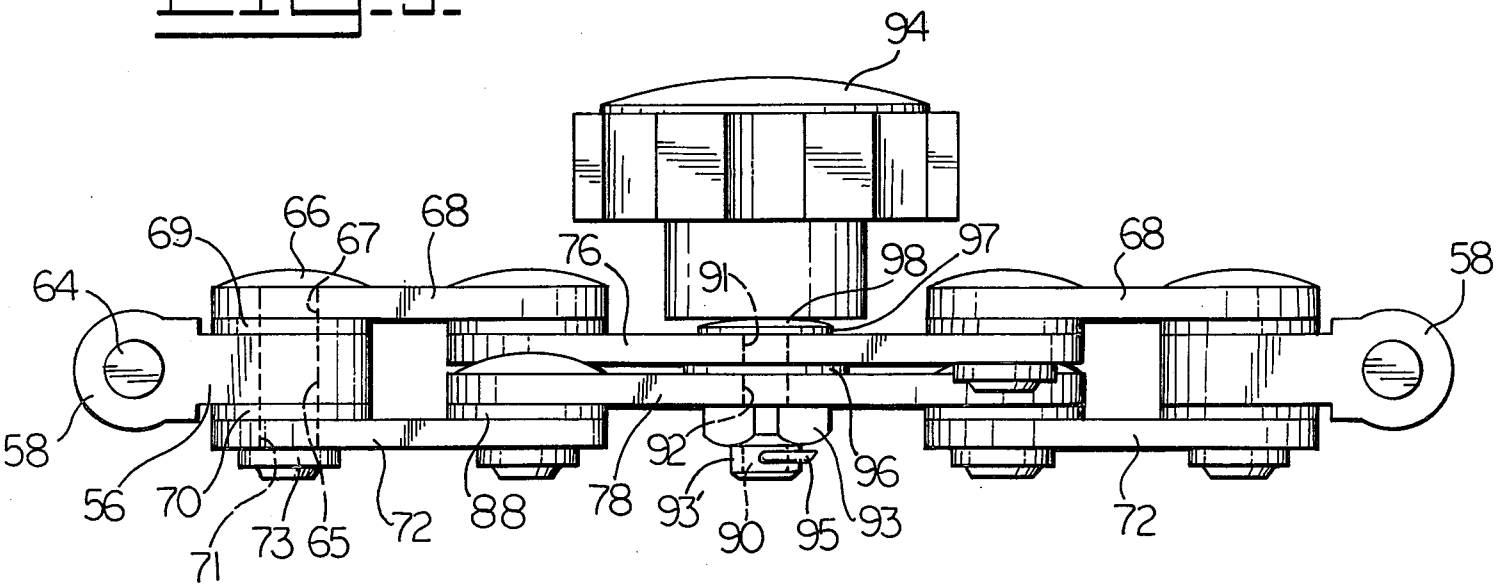
FIG. 5 is an enlarged side elevational view of the linkage assembly of FIG. 4.

Referring to the drawings, and in particular FIGS. 1 through 3, a cab 10 is shown mounted on a vehicle 12, such as a loader or the like. The cab 10 includes a roof 16, side walls 18 and 20, a rear wall 24 and a front wall 22. The side walls 18, 20 and the rear wall 24 have windows 26 therein with a door 28 in the side wall 18. The rear wall 24 has a rearwardly offset frame 30 defining an opening 32 over which a window 34 is adapted to be seated. A resilient seal 36 is affixed in the offset 30 against which the window 34 seats to effect a seal around the window. The window 34 has a pair of hinges 38 connected between anchors 40 on the upper portion 41 of the window 34 and brackets 42 connected on the inside of said rear wall 24 so that the lower portion 45 of the window 34 can be hinged in a rearward direction from the offset frame 30 of the cab 10. The hinges 38 include hinge pins 44 connecting the hinges 38 to the bracket 42. The pins 44 have longitudinal axes which are substantially in line with each other. Although this description will proceed with respect to the rear window 34 as being the member that is mounted for hinged motion about the top portion thereof, it is to be understood that the window could be a side window or could be a panel that is desirable or necessary to open relative to the frame of the cab.

As shown in FIGS. 2 through 5, a linkage and lock actuator assembly 50 is mounted between a fixed portion of the cab 10, such as a deck 51 in the cab 10, and the lower portion 45 of the window or panel 34 so that actuation of the linkage and lock assembly 50 will pivot the lower portions 45 of the window 34 outward relative to the offset frame 30 of the cab 10 so as either to permit air to enter the cab, or to close the window against the seal 36 of the frame 30.

The actuator assembly 50 is comprised of a scissors-type or lazy tong-type linkage arrangement which has at each end portion 52 and 54 thereof a mounting member 56 which includes a projecting hinge portion 58 extending between a pair of spaced arms 60 on the mounting brackets 62 and 63 carried, respectively, on the lower portion 45 of the window 34 and on the deck 51 in the cab 10. A hinge pin 64 passes through the arms 60 and the hinge portion 58 to permit the actuator assembly 50 to pivot about the longitudinal axis of the pins 64. The longitudinal axis of each pin 64 lies substantially parallel to each other and lies parallel to the longitudinal axes of the pins 44 of hinges 38 about which the window or panel 34 is hingedly mounted.

Each mounting member 56, on each end of the actuator assembly 50, has an aperture 65 extending therethrough in a direction transverse to the direction of the pin 64. A headed pin 66 extends through an opening 67 in one end portion of a short link 68, through a washer 69, through the aperture 65 in the mounting member 56, through washer 70, through an opening 71 in one end portion of a short link 72 and is fastened by peening over the end of said pin 66 against a washer 73. The ends of the short links 68,72 are free to pivot about the axes of the pins 66 in planes parallel to each other.

A pair of long links 76,78 are crossed at the midportion thereof and have their ends pivotally connected to the free ends of the four short links 68,72, 68,72. That is, one short link 68, on end portion 52 of the actuator 50, is pivotally connected by headed pin 80 to the one end of the long link 76 with the opposite end of said long link 76 being pivotally connected by headed pin 82 to the end of the other short link 68 at the other end portion 54 of said actuator 50. Likewise, long link 78 is connected by headed pin 84 to the short link 72 at the one end portion 52 of the actuator 50 with the other end of said long link 78 being connected by headed pin 86 to the other short link 72 at the other end portion 54 of the actuator 50. A washer 88 is positioned between each short link 68,72, 68,72 and each end of each long link 76,78 so that the links are free to pivot about the pins 80,82,84,86 substantially in planes parallel to each other. A threaded stud 90 passes through aligned openings 91,92 in the midportions of the long links 76,78, respectively, to which a knurled or shaped knob 94 is threadedly attached on the upwardly extending portion thereof. The stud 90 has a nut 93 threaded on the lower portion thereof with a stop nut 93' held in abutting relation to said nut 93 by a key 95 passing through said nut 93' and through said stud 90. A washer 96 is positioned between the overlapping or crossing long links 76,78 where the stud 90 passes therethrough so as to form opposite bearing surfaces against the respective long links 76,78 at the crossover point. A further washer 97 encircles the stud 90 above the upper long link 76 and has a resilient dish-shaped washer 98 bearing against the upper surface thereof and bearing against the lower portion of the knurled knob 94. Turning the knurled knob 94 down on the stud 90 will flatten the dish-shaped washer 98 and will grip the crossed over long links 76,78 between the nut 93 and the knob 94 and against the facing surfaces on the washers. Sufficient tightening of the knob 94 will lock the crossed over long links 76,78 in position relative to each other thereby establishing the linkage arrangement as a fixed link, such that the link cannot be elongated or foreshortened as long as the locking effect of the tightened knob 94 on the stud 90 is maintained.

Loosening the knob 94 on the stud 90 will make it possible to either push on the knob 94 outward to elongate the linkage and swing the bottom portion 45 of the window or panel 34 away from the opening 32 in the cab 10. At the desired location, the knob 94 can again be tightened to hold the window 34 in the fixed position. Once again, loosening the knob 94 and pulling the knob 94 toward the inside of the cab 10 will pivot the window 34 toward the opening 32 in the cab 10 until the bottom edge of the window 34 is against the seal 36 of the frame 30 of the cab 10 and the linkage is collapsed into a shortened condition. At that point, the knob 94 can, once again, be tightened to lock the window 34 closed against the frame.

The mounting members 56,at each end of the actuator 50, are free to pivot about axes parallel to the axes of the hinges 38 of the windshield or panel 34 so that as the window 34 is moved outwardly away from the cab 10, the ends of the actuator 50 will be free to pivot relative to the plane of the window 34 and rblative to the fixed bracket 63 on the deck 51 of the actuator 50. The vertically disposed pins 66,80,84,82,86,66, which have axes which are perpendicular to the axis of the hinge pins 64,64,44, permit the linkage arrangement 50 to be elongated or foreshortened by applying pressure on the knob 94 outward or inward depending upon the dictates of the operator. The actuator 50, when in its fully collapsed condition, occupies a minimum of space along the base of the window or panel 34 and does not have any protruding elongate rods or bars extending into or parallel to the base of the window. The pivots 80,82, 84,86 between the ends of the long links 76,78 and the short links 68,68, 72,72 and between the ends of the short links 68,68, 72,72 and the mounting members 56 are relatively large so as to provide support between the overlapping portions of the links, thereby confining the movement of the actuator 50 to planes parallel to each other and substantially perpendicular to the axes of said pivots. In the extended or collapsed condition of the actuator 50, the pivots 80,84 and 82,86 are spaced apart and the long and short links are angularly disposed to each other with overlapping flat surfaces in contact with each other such that the actuator 50 is not likely to twist and, due to the firm mounting of the pivots, the actuator 50 will not vibrate and, therefore, will not work itself loose. Due to the arrangement of long and short links, the forces required to swing the panel or window 34 open or closed is distributed in such a way that the finished actuator 50 can be extended farther or collapsed into a smaller package than anything available heretofore. In this way, the spacing between the mount at the base of the window 34, when the window 34 is closed, and the mount affixed to the deck 51 in the cab 10 can be minimal without in any way affecting the effectiveness or operation of the actuator.

It is to be understood that although the description has proceeded with a linkage assembly comprised of four short links and two long links, additional links could be provided at each end of the assembly to produce a longer actuator without departing from the invention.

I claim:

1. In a window actuating mechanism comprising a frame having an opening therein with a flat deck extending laterally inwardly from one edge of said opening, hinge means fastened to an edge of said opening in the frame opposite to said edge with said flat deck, said hinge means hingedly mounting said window on said frame in closing relation to said opening, and linkage means extending between said panel and the deck on said frame, a pair of mounting members at each end of said linkage means with each mounting member having a pivot axis lying parallel to the axis of the hinge means of said window to said frame, one of said mounting members being mounted on said window and the other of said mounting members being mounted on said flat deck, a pair of short links pivotally mounted to each one of said mounting members for pivotal movement about an axis perpendicular to the pivot axis of said mounting members, a pair of long links crossing each other at the midportion of each long link and having one end portion of each long link pivotally connected to one end portion of one of said short links, each said last-named pivotal connection having an axis lying parallel to the axis of said pivotal mounting of said short links to said mounting members, a pivot passing through the crossover midportions of said long links, and a locking and actuating knob threaded onto said last-named pivot whereby loosening said knob on said pivot makes it possible to push and pull on said knob parallel to a plane containing said short links and said long links for elongating and foreshortening said linkage means as said window is opened and closed over said opening in the frame, and whereby tightening said knob locks said long links together thereby locking the linkage means and preventing further elongation or foreshortening of said linkage means.

* * * * *